US010621916B2

(12) United States Patent
Qing et al.

(10) Patent No.: US 10,621,916 B2
(45) Date of Patent: Apr. 14, 2020

(54) DRIVING CIRCUIT AND DRIVING METHOD THEREOF, AND DISPLAY DEVICE

(71) Applicants: CHENGDU BOE OPTOELECTRONICS TECHNOLOGY CO., LTD., Chengdu, Sichuan (CN); BOE TECHNOLOGY GROUP CO., LTD., Beijing (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD, Chengdu, Sichuan (CN)

( * ) Notice: Subject to any disclaimer, the term of this patent is extended or adjusted under 35 U.S.C. 154(b) by 0 days.

(21) Appl. No.: 16/433,699

(22) Filed: Jun. 6, 2019

(65) Prior Publication Data

US 2019/0287461 A1 Sep. 19, 2019

Related U.S. Application Data

(62) Division of application No. 15/513,080, filed as application No. PCT/CN2016/073842 on Feb. 16, 2016, now Pat. No. 10,403,202.

(30) Foreign Application Priority Data

Sep. 23, 2015 (CN) ..... 2015 1 0612395

(51) Int. Cl.
*G09G 3/30* (2006.01)
*G09G 3/3233* (2016.01)

(52) U.S. Cl.
CPC ... *G09G 3/3233* (2013.01); *G09G 2300/0861* (2013.01); *G09G 2310/0262* (2013.01);
(Continued)

(58) Field of Classification Search
CPC ..... G09G 3/3208; G09G 2320/043; G09G 2320/045; G09G 2320/0204
See application file for complete search history.

(56) References Cited

U.S. PATENT DOCUMENTS

2014/0111562 A1 4/2014 Wu et al.
2017/0061870 A1 3/2017 Kang

FOREIGN PATENT DOCUMENTS

CN 101986378 A 3/2011
CN 102651194 A 8/2012
CN 102651198 A 8/2012
CN 102682704 A 9/2012
(Continued)

OTHER PUBLICATIONS

International Search Report and Written Opinion dated Jun. 16, 2016; PCT/CN2016/073842.
(Continued)

*Primary Examiner* — Roy P Rabindranath
(74) *Attorney, Agent, or Firm* — Ladas & Parry LLP

(57) ABSTRACT

Provided are a driving circuit and a driving method thereof, and a display device. The driving circuit includes a signal line, a control line, a driving unit, a power supply unit, a compensation unit, a light emitting control unit, a data writing unit, a storage unit, and an aging alleviation unit, wherein the driving unit is configured to drive a light emitting element; the light emitting control unit is configured to control the light emitting element to emit light; the data writing unit is configured to write the data signal into the storage unit; the compensation unit is configured to perform threshold voltage compensation for the driving unit; and the aging alleviation unit is configured to short-circuit a cathode and an anode of the light emitting element.

14 Claims, 6 Drawing Sheets

(52) U.S. Cl.
CPC ..... *G09G 2320/0233* (2013.01); *G09G 2320/043* (2013.01); *G09G 2320/045* (2013.01); *G09G 2320/0693* (2013.01); *G09G 2330/02* (2013.01)

(56) References Cited

FOREIGN PATENT DOCUMENTS

| | | | |
|---|---|---|---|
| CN | 203858847 | U | 10/2014 |
| CN | 104157238 | A | 11/2014 |
| CN | 104167168 | A | 11/2014 |
| CN | 104318899 | A | 1/2015 |
| CN | 104616621 | A | 5/2015 |
| CN | 105070250 | A | 11/2015 |
| EP | 1102234 | A2 | 5/2001 |
| KR | 100592636 | B1 | 6/2006 |

OTHER PUBLICATIONS

The First Chinese Office Action dated Feb. 6, 2017; Appln No. 201510612395.5.
The Second Chinese Office Action dated Apr. 12, 2017; Appln. No. 201510612395.5.
The Third Chinese Office Action dated Oct. 9, 2017; Appln. No. 201510612395.5.
USPTO RR dated May 3, 2018 in connection with U.S. Appl. No. 15/513,080.
USPTO NFOA dated Jul. 25, 2018 in connection with U.S. Appl. No. 15/513,080.
USPTO FOA dated Jan. 22, 2019 in connection with U.S. Appl. No. 15/513,080.
USPTO NOA mailed Apr. 24, 2019 in connection with U.S. Appl. No. 15/513,080.
USPTO Corrected Notice of Allowance dated May 13, 2019 in connection with U.S. Appl. No. 15/513,080.

DRIVING CIRCUIT AND DRIVING METHOD THEREOF, AND DISPLAY DEVICE

CROSS-REFERENCE TO RELATED APPLICATIONS

This disclosure claims the benefit of priority from a Chinese patent application No. 201510612395.5 filed on Sep. 23, 2015, the entire contents of which are incorporated herein by reference.

TECHNICAL FIELD

The present disclosure relates to a field of display technique, and particularly to a driving circuit and a driving method thereof, and a display device.

BACKGROUND

An OLED (organic light emitting diode) display is a current-driven light emitting device. That is, the OLED display is driven to emit light by a current generated by a driving tube TFT in a saturated state.

No matter Low Temperature Poly-silicon Transistor (LTPS-TFT) or Oxide-TFT, non-uniformity during manufacturing always results in that transistors in different locations have a threshold voltage difference, which is vital for driving consistency of a current-driven device (such as an OLED light emitting element), because when threshold voltages of different driving tubes are different in the case of inputting the same gray-scale voltage, the different threshold voltages will produce different driving currents, and thereby lead to inconsistency of the driving currents. Therefore, the conventional OLED driving circuit needs to compensate for the threshold voltages of the driving tubes, so that the driving currents are no longer affected by inconsistency of the threshold voltages of the driving tubes.

In addition, as the use time of the OLED light emitting element increases, a great many of non-recombined carriers accumulate in an internal interface of a light emitting layer of the OLED light emitting element, and accumulation of the carriers causes a built-in electric field to be formed inside the OLED light emitting element, makes the threshold voltage of the OLED light emitting element rise, which directly causes aging of luminescent material of the OLED light emitting element and shortens a lifespan of the OLED light emitting element.

At present, the conventional OLED driving circuit requires at least seven transistors to simultaneously achieve compensation for the threshold voltages of the driving tubes and aging alleviation of luminescent material of the OLED light emitting element, which limits the OLED display's resolution to a certain extent.

SUMMARY

In view of the above technical problems existing in the prior art, the present disclosure provides a driving circuit and a driving method thereof, and a display device. The driving circuit not only can achieve compensation for threshold voltages of respective driving units, make driving currents of the respective driving units be consistent, and thereby ensure uniformity of luminance of the light emitting element; meanwhile, the driving circuit can also remove non-recombined carriers in the internal interface of the light emitting layer of the light emitting element by means of short-circuiting a cathode and an anode of the light emitting element, thereby alleviate aging of the luminescent material in the light emitting element and extend a lifespan of the luminescent material.

The present disclosure provides a driving circuit for driving a light emitting element. The driving circuit comprises a signal line, a control line, a driving unit, a power supply unit, a compensation unit, a light emitting control unit, a data writing unit, a storage unit, and an aging alleviation unit. The power supply unit is configured to provide a power supply signal for the driving circuit. The driving unit is configured to drive the light emitting element. The signal line is configured to provide a data signal for the data writing unit. The control line is configured to provide a control signal for the compensation unit, the light emitting control unit, the data writing unit, and the aging alleviation unit. The light emitting control unit is configured to control the light emitting element to emit light. The data writing unit is configured to write the data signal into the storage unit. The storage unit is configured to store a voltage of the data signal written by the data writing unit. The compensation unit is configured to perform threshold voltage compensation for the driving unit according to the data signal and the control signal. The aging alleviation unit is configured to short-circuit a cathode and an anode of the light emitting element according to the control signal.

Optionally, the control line includes a scan control line, a compensation control line, and a light emitting control line, the scan control line is connected to the data writing unit, the compensation control line is connected to the compensation unit, and the light emitting control line is connected to the light emitting control unit. The power supply unit includes a first power supply terminal connected to the compensation unit and the driving unit, and a second power supply terminal connected to the aging alleviation unit and the light emitting element.

According to an embodiment of the present disclosure, the driving unit includes a driving tube, the compensation unit includes a third switching tube, the light emitting control unit includes a first switching tube and a fourth switching tube, the data writing unit includes a fifth switching tube, and the storage unit includes a capacitor. A gate of the first switching tube is connected to the light emitting control line, a first electrode of the first switching tube is connected to a second electrode of the capacitor and a second electrode of the driving tube, and a second electrode of the first switching tube is connected to an anode of the light emitting element. A gate of the third switching tube is connected to the compensation control line, a first electrode of the third switching tube is connected to the first power supply terminal and a first electrode of the driving tube, and a second electrode of the third switching tube is connected to a gate of the driving tube. A gate of the fourth switching tube is connected to the light emitting control line, a first electrode of the fourth switching tube is connected to the gate of the driving tube and the second electrode of the third switching tube, and a second electrode of the fourth switching tube is connected to a first electrode of the capacitor. A gate of the fifth switching tube is connected to the scan control line, a first electrode of the fifth switching tube is connected to the signal line, and a second electrode of the fifth switching tube is connected to the first electrode of the capacitor and the second electrode of the fourth switching tube. The second power supply terminal is connected to a cathode of the light emitting element.

Optionally, the aging alleviation unit includes a second switching tube, a gate of the second switching tube is connected to the scan control line or the compensation control line, a first electrode of the second switching tube is connected to the anode of the light emitting element, and a second electrode of the second switching tube is connected to the cathode of the light emitting element.

Optionally, the first switching tube, the second switching tube, the third switching tube, the fourth switching tube, the fifth switching tube, and the driving tube all are N-type thin film transistors.

Optionally, a voltage of the data signal provided by the signal line is larger than a first power supply voltage provided by the first power supply terminal.

According to another embodiment of the present disclosure, the driving unit includes a driving tube; the compensation unit includes a fourth switching tube; the light emitting control unit includes a first switching tube and a third switching tube; the data writing unit includes a second switching tube; and the storage unit includes a capacitor. A gate of the first switching tube is connected to the light emitting control line, a first electrode of the first switching tube is connected to the first power supply terminal, and a second electrode of the first switching tube is connected to a second electrode of the capacitor and a first electrode of the driving tube. A gate of the second switching tube is connected to the scan control line, a first electrode of the second switching tube is connected to the signal line, and a second electrode of the second switching tube is connected to a first electrode of the capacitor. A gate of the third switching tube is connected to the light emitting control line, a first electrode of the third switching tube is connected to the first electrode of the capacitor and the second electrode of the second switching tube, and the second electrode of the third switching tube is connected to the gate of the driving tube. A gate of the fourth switching tube is connected to the compensation control line, a first electrode of the fourth switching tube is connected to the gate of the driving tube and the second electrode of the third switching tube, and a second electrode of the fourth switching tube is connected to the second electrode of the driving tube and the anode of the light emitting element. The cathode of the light emitting element is connected to the second power supply terminal.

Optionally, the aging alleviation unit includes a fifth switching tube, a gate of the fifth switching tube is connected to the compensation control line or the scan control line, a first electrode of the fifth switching tube is connected to the anode of the light emitting element, and a second electrode of the fifth switching tube is connected to the cathode of the light emitting element.

Optionally, the first switching tube, the second switching tube, the third switching tube, the fourth switching tube, the fifth switching tube, and the driving tube all are P-type thin film transistors.

Optionally, a voltage of the data signal provided by the signal line is smaller than a second supply voltage provided by the second power supply terminal.

Optionally, the first power supply voltage provided by the first power supply terminal is larger than the second power supply voltage provided by the second power supply terminal.

The present disclosure further provides a display device, comprising a light emitting element and the driving circuit described above, the driving circuit being connected to the light emitting element and configured to drive the light emitting element.

The present disclosure further provides a method for driving the driving circuit described above, the method comprises the steps of: providing, by a power supply unit, a power supply signal for the driving circuit; driving, by a driving unit, the light emitting element to emit light under control of a control line; providing, by a signal line, a data signal for a data writing unit under control of the control line; controlling, by a light emitting control unit, the light emitting element to emit light under control of the control line; writing, by the data writing unit, the data signal into a storage unit under control of the control line; storing, by the storage unit, a voltage of the data signal written by the data writing unit; performing, by a compensation unit, threshold voltage compensation for the driving unit under control of the control line; and short-circuiting, by an aging alleviation unit, a cathode and an anode of the light emitting element under control of the control line Optionally, in the method, the control line includes a scan control line, a compensation control line, and a light emitting control line, and the power supply unit includes a first power supply terminal and a second power supply terminal. The method comprises four stages. In a first stage, the signal line writes the data signal into the storage unit through the data writing unit under control of the scan control line, meanwhile the aging alleviation unit short-circuits the cathode and the anode of the light emitting element under control of the scan control line. In a second stage, the compensation unit performs threshold voltage compensation under control of the compensation control line, meanwhile the aging alleviation unit continues to short-circuit the cathode and the anode of the light emitting element under control of the scan control line. In a third stage, the control signals of the scan control line and the compensation control line jump simultaneously, the compensation unit, the light emitting control unit, the data writing unit, and the aging alleviation unit are simultaneously turned off. In a fourth stage, the light emitting control unit controls the light emitting element to emit light under control of the light emitting control line.

Optionally, in the first stage, the light emitting control line and the scan control line output a first voltage level, and the compensation control line outputs a second voltage level; in the second stage, the light emitting control line outputs a second voltage level, the scan control line and the compensation control line output a first voltage level; in the third stage, the light emitting control line, the scan control line, and the compensation control line output a second voltage level; and in the fourth stage, the light emitting control line outputs a first voltage level, the scan control line and the compensation control line output a second voltage level. The first voltage level and the second voltage level are one of a high voltage level and a low voltage level, respectively.

Advantageous effects of the present disclosure: the driving circuit provided by the present disclosure can, by means of setting the compensation unit, the aging alleviation unit, the driving unit, the light emitting control unit, the data writing unit, and the storage unit, achieve compensation for threshold voltages of respective driving units, make driving currents of the respective driving units be consistent, and thereby ensure uniformity of luminance of the light emitting element; and the driving circuit can further remove non-recombined carriers in the internal interface of the light emitting layer of the light emitting element by means of short-circuiting the cathode and the anode of the light emitting element, thereby alleviate aging of the luminescent material in the light emitting element and extend a lifespan of the luminescent material.

By adopting the driving circuit described above, the display device provided by the present disclosure can make the driving currents for the respective pixels in the display device tend to be consistent during the process of driving, which thereby ensures luminance uniformity during displaying of the display device and extends the lifespan of the display device.

DESCRIPTION OF REFERENCE SIGNS

1: compensation unit; 2: aging alleviation unit; 3: driving unit; 4: light emitting control unit; 5: data writing unit; 6: storage unit.

DETAILED DESCRIPTION OF THE EMBODIMENTS

In order to make those skilled in the art to better understand the technical solutions of the present disclosure, hereinafter, the driving circuit and the driving method thereof, and the display device provided by the present disclosure will be described in detail with reference to the accompanying drawings and the embodiments.

A First Embodiment

Figure 1:
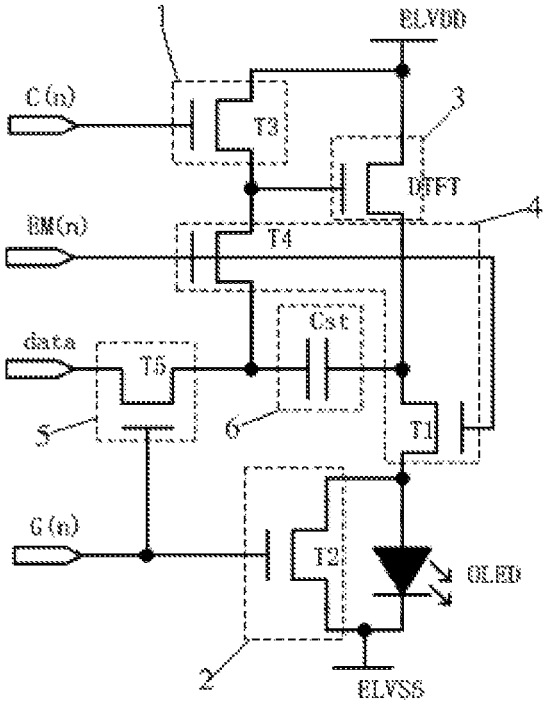
FIG. 1 is a circuit diagram of the driving circuit according to a first embodiment of the present disclosure.

This embodiment provides a driving circuit for driving a light emitting element OLED, as shown in FIG. 1, the driving circuit comprises a signal line data, a control line, a driving unit 3, a power supply unit, a compensation unit 1, a light emitting control unit 4, a data writing unit 5, a storage unit 6, and an aging alleviation unit 2. The power supply unit is configured to provide a power supply signal for the driving circuit; the driving unit 3 is configured to drive the light emitting element OLED; the signal line data is configured to provide a data signal for the data writing unit 5; the control line is configured to provide a control signal for the compensation unit 1, the light emitting control unit 4, the data writing unit 5, and the aging alleviation unit 2; the light emitting control unit 4 is configured to control the light emitting element OLED to emit light; the data writing unit 5 is configured to write the data signal into the storage unit 6; the storage unit 6 is configured to store a voltage of the data signal written by the data writing unit 5; the compensation unit 1 is configured to perform threshold voltage compensation for the driving unit 3 according to the control signal; and the aging alleviation unit 2 is configured to short-circuit a cathode and an anode of the light emitting element OLED according to the control signal.

By means of setting the compensation unit 1, the driving unit 3, the light emitting control unit 4, the data writing unit, 5 and the storage unit 6, the driving circuit provided by this embodiment can compensate for threshold voltages of respective driving units, make driving currents of the respective driving units tend to be consistent, and thereby ensure uniformity of luminance of the light emitting element. In addition, by means of setting the aging alleviation unit 2 to short-circuit the cathode and the anode of the light emitting element, the driving circuit provided by this embodiment can further remove non-recombined carriers in the internal interface of the light emitting layer of the light emitting element OLED, thereby alleviate aging of the luminescent material and extend a lifespan of the luminescent material.

In this embodiment, the control line includes a scan control line G(n), a compensation control line C(n), and a light emitting control line EM(n), the scan control line G(n) is connected to the data writing unit 5, the compensation control line C(n) is connected to the compensation unit 1, and the light emitting control line EM(n) is connected to the light emitting control unit 4. The power supply unit includes a first power supply terminal ELVDD connected to the compensation unit 1 and the driving unit 3, and a second power supply terminal ELVSS connected to the aging alleviation unit 2 and the light emitting element OLED.

In this embodiment, the driving unit 3 includes a driving tube DTFT, the compensation unit 1 includes a third switching tube T3, the light emitting control unit 4 includes a first switching tube T1 and a fourth switching tube T4, the data writing unit 5 includes a fifth switching tube T5, and the storage unit 6 includes a capacitor Cst. A gate of the first switching tube T1 is connected to the light emitting control line EM(n), a first electrode of the first switching tube T1 is connected to a second electrode of the capacitor Cst and a second electrode of the driving tube DTFT, and a second electrode of the first switching tube T1 is connected to an anode of the light emitting element OLED. A gate of the third switching tube T3 is connected to the compensation control line C(n), a first electrode of the third switching tube T3 is connected to the first power supply terminal ELVDD and a first electrode of the driving tube DTFT, and a second electrode of the third switching tube T3 is connected to a gate of the driving tube DTFT. A gate of the fourth switching tube T4 is connected to the light emitting control line EM(n), a first electrode of the fourth switching tube T4 is connected to the gate of the driving tube DTFT and the second electrode of the third switching tube T3, and a second electrode of the fourth switching tube T4 is connected to a first electrode of the capacitor Cst. A gate of the fifth switching tube T5 is connected to the scan control line G(n), a first electrode of the fifth switching tube T5 is connected to the signal line data, a second electrode of the fifth switching tube T5 is connected to the first electrode of the capacitor Cst and the second electrode of the fourth switching tube T4. The second power supply terminal ELVSS is connected to a cathode of the light emitting element OLED.

In this embodiment, the aging alleviation unit 2 includes a second switching tube T2, a gate of the second switching tube T2 is connected to the scan control line G(n), a first electrode of the second switching tube T2 is connected to the anode of the light emitting element OLED, and a second electrode of the second switching tube T2 is connected to the cathode of the light emitting element OLED.

It should be noted that, the gate of the second switching tube T2 may also be connected to the compensation control line C(n). No matter the gate of the second switching tube T2 is connected to the scan control line G(n) or the compensation control line C(n), the second switching tube T2 can short-circuit the cathode and the anode of the light emitting element according to the control signal provided by the control line, thereby remove non-recombined carriers in the light emitting element OLED, and achieve the function of alleviating aging of the luminescent material in the light emitting element OLED.

In this embodiment, the first switching tube T1, the second switching tube T2, the third switching tube T3, the fourth switching tube T4, the fifth switching tube T5, and the driving tube DTFT are all N-type thin film transistors.

In this embodiment, a voltage Vdata of the data signal provided by the signal line data is larger than a first power supply voltage VDD provided by the first power supply terminal ELVDD. The first power supply voltage VDD provided by the first power supply terminal ELVDD is larger than a second power supply voltage VSS provided by the second power supply terminal ELVSS.

Based on the structure of the driving circuit described above, this embodiment further provides a method for driving the driving circuit, the method comprises: providing, by a power supply unit, a power supply signal for the driving circuit; driving, by a driving unit 3, the light emitting element OLED to emit light under control of a control line; providing, by a signal line data, a data signal for a data writing unit 5 under control of the control line; controlling, by a light emitting control unit 4, the light emitting element OLED to emit light under control of the control line; writing, by the data writing unit 5, the data signal into a storage unit 6 under control of the control line; storing, by the storage unit 6, a voltage of the data signal written by the data writing unit 5; performing, by a compensation unit 1, threshold voltage compensation for the driving unit 3 under control of the control line; and short-circuiting, by an aging alleviation unit 2, a cathode and an anode of the light emitting element OLED under control of the control line.

Figure 2:
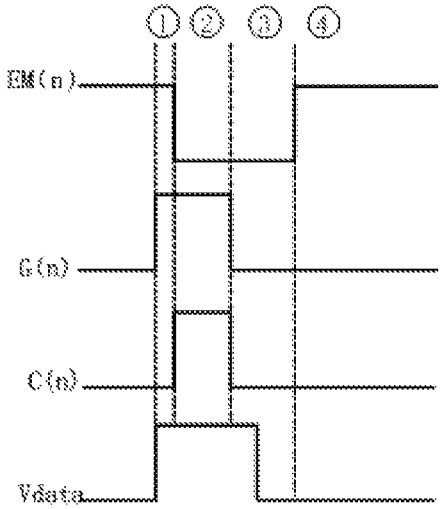
FIG. 2 is a driving timing diagram of the driving circuit of FIG. 1.

In this embodiment, the control line includes a scan control line G(n), a compensation control line C(n), and a light emitting control line EM(n), and the power supply unit includes a first power supply terminal ELVDD and a second power supply terminal ELVSS, the storage unit 6 includes a capacitor Cst; the driving unit 3 includes a driving tube DTFT; the first electrode of the driving tube DTFT is a drain, and the second electrode of the driving tube DTFT is a source. FIG. 2 shows a driving timing diagram of this method for driving, which comprises four stages.

In a first stage ①, the signal line data writes the data signal into the capacitor Cst through the data writing unit 5 under control of the scan control line G(n), so as to charge the capacitor Cst, meanwhile the aging alleviation unit 2 short-circuits the cathode and the anode of the light emitting element OLED under control of the scan control line G(n).

Figure 3:
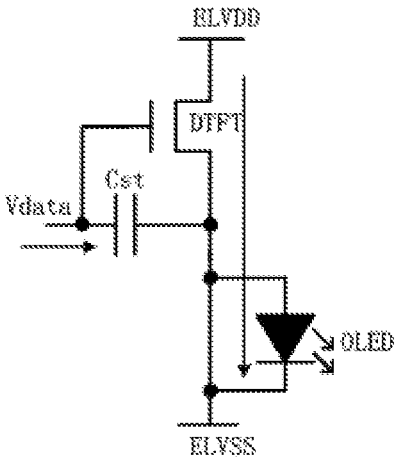
FIG. 3 is an equivalent circuit diagram of the driving circuit of FIG. 1 in a first stage.

In this stage, the scan control line G(n) and the light emitting control line EM(n) output a high voltage level signal, and the compensation control line C(n) outputs a low voltage level signal. The first switching tube T1, the second switching tube T2, the fourth switching tube T4, and the fifth switching tube T5 are turned on, and the third switching tube T3 is turned off. The equivalent circuit of the driving circuit in FIG. 1 is as shown in FIG. 3. Since the fourth switching tube T4 is turned on, a voltage between the gate and the source of the driving tube DTFT is thus a voltage difference between two terminals of the capacitor Cst, turning-on of the fifth switching tube T5 enables the data signal provided by the signal line data to be directly written into the first electrode of the capacitor Cst that is connected to the gate of the fifth switching tube T5; turning-on of the first switching tube T1 and the second switching tube T2 pulls the source of the driving tube DTFT to a potential of the second power supply terminal ELVSS (i.e., the second power supply voltage VSS), meanwhile, the cathode and the anode of the light emitting element OLDE is short-circuited by the second switching tube T2, thus, in the first stage, non-recombined carriers in the internal interface of the light emitting layer of the light emitting element OLED are removed, aging of the luminescent material of the light emitting element OLDE is alleviated. Meanwhile, the capacitor Cst is charged, the voltage difference between two terminals of the capacitor Cst after completion of the charging is VCst=Vdata−VSS. Because the driving tube DTFT has a relatively large gate-source voltage in this stage, the current flowing through the driving tube DTFT is relatively large, the capacitor Cst is charged at a relatively fast speed, thereby a time period of the first stage may be relatively short.

In a second stage ②, the compensation unit 1 produces a threshold compensation voltage under control of the compensation control line C(n), meanwhile the aging alleviation unit 2 continues to short-circuit the cathode and the anode of the light emitting element OLED under control of the scan control line G(n).

Figure 4:
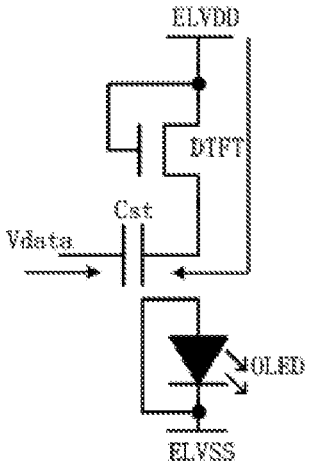
FIG. 4 is an equivalent circuit diagram of the driving circuit of FIG. 1 in a second stage.

In this stage, the scan control line G(n) and the compensation control line C(n) output a high voltage level signal, and the light emitting control line EM(n) outputs a low voltage level signal. The first switching tube T1 and the fourth switching tube T4 are turned off. The second switching tube T2, the third switching tube T3, and the fifth switching tube T5 are turned on. The equivalent circuit of the driving circuit in FIG. 1 is as shown in FIG. 4, Since the third switching tube T3 is turned on and the fourth switching tube T4 is turned off, the driving tube DTFT is connected in a manner of diode, potentials of the gate and the drain of the driving tube DTFT are both the first power supply voltage VDD, a potential of the source of the driving tube DTFT maintains the second power supply voltage VSS in the previous stage. Accordingly, the driving tube DTFT is in a saturated state. Since the first switching tube T1 is turned off, the current flowing through the driving tube DTFT flows into the second electrode of the capacitor Cst that is connected to the source of the driving tube DTFT, so as to charge the capacitor Cst, until a potential of the second electrode of the capacitor Cst that is connected to the source of the driving tube DTFT is pulled up to VDD-Vth (Vth is the threshold voltage of the driving tube DTFT, VDD is the first power supply voltage), in this case, the driving tube DTFT is turned off, and since the fifth switching tube T5 is still turned on, the first electrode of the capacitor Cst is not floating, instead it always maintains the potential of the voltage Vdata of the data signal, accordingly, after the driving tube DTFT is turned off, the voltage difference between two terminals of the capacitor Cst is VCst=Vdata−(VDD−Vth). In this stage, the second switching tube T2 maintains turned-on, so that the cathode and the anode of the light emitting element OLED is short-circuited, aging of the OLED luminescent material is further alleviated.

In a third stage ③, the control signals of the scan control line G(n), the compensation control line C(n), and the light emitting control line EM(n) all are a low voltage level, the compensation unit 1, the light emitting control unit 4, the data writing unit 5, and the aging alleviation unit 2 are simultaneously turned off.

Figure 5:
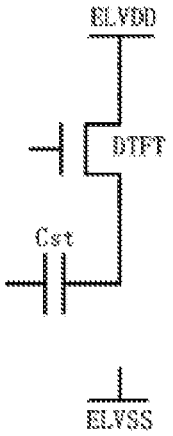
FIG. 5 is an equivalent circuit diagram of the driving circuit of FIG. 1 in a third stage.

In this stage, the scan control line G(n), the compensation control line C(n), and the light emitting control line EM(n) all output a low voltage level signal. The first switching tube T1, the second switching tube T2, the third switching tube T3, the fourth switching tube T4, and the fifth switching tube T5 all are turned off. The equivalent circuit of the driving circuit in FIG. 1 is as shown in FIG. 5. This stage serves as a buffering stage, which avoids interference caused by that the control signals of the scan control line G(n), the compensation control line C(n), and the light emitting control line EM(n) jump simultaneously, so that signals in the whole driving circuit are more stable.

In a fourth stage ④, the light emitting control unit 4 controls the light emitting element OLED to emit light under control of the light emitting control line EM(n).

Figure 6:
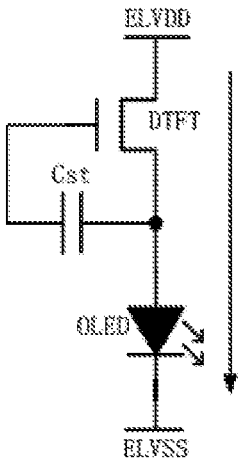
FIG. 6 is an equivalent circuit diagram of the driving circuit of FIG. 1 in the fourth stage.

In this stage, the scan control line G(n) and the compensation control line C(n) both output a low voltage level signal, and the light emitting control line EM(n) outputs a high voltage level signal. Thus, the first switching tube T1 and the fourth switching tube T4 are turned on, the second switching tube T2, the third switching tube T3, and the fifth switching tube T5 are all turned off. The equivalent circuit of the driving circuit in FIG. 1 is as shown in FIG. 6. The fourth switching tube T4 is turned on, the capacitor Cst is connected between the gate and the source of the driving tube DTFT, the first switching tube T1 is turned on, the anode of the light emitting diode OLED is connected to the source of the driving tube DTFT, the cathode of the light emitting diode OLED is connected to the second power supply terminal ELVSS. Since the gate of the driving tube DTFT connected to the capacitor Cst is in a floating state, the voltage between two terminals of the capacitor Cst maintains the previous voltage, that is, VCst=Vdata−(VDD−Vth). And since the capacitor Cst is connected between the gate and the source of the driving tube DTFT, the voltage Vgs between the gate and the source of the driving tube DTFT is the voltage difference VCst between two terminals of the capacitor Cst. The first power supply voltage VDD is set to ensure that the voltage Vds between the drain and the source of the driving tube DTFT satisfies Vds>Vgs−Vth, to as to make the driving tube DTFT operate in a saturated state. Accordingly, a light emitting current of the light emitting element OLED is:

$$\begin{aligned} Ioled &= K(Vgs - Vth)^2 \\ &= K(VCst - Vth)^2 \\ &= K(Vdata - (VDD - Vth) - Vth)^2 \\ &= K(Vdata - VDD)^2. \end{aligned}$$

It should be noted that, in this embodiment, the voltage Vdata of the data signal is larger than the first power supply voltage VDD. K is a constant associated with manufacturing process and design.

It can be known from the above equations that, the light emitting current provided by the driving circuit in this embodiment to drive the light emitting element OLED is only related to the voltage Vdata of the data signal and the first power supply voltage VDD, but is irrelevant to the threshold voltage Vth of the driving tube DTFT. In other words, compensation for the threshold voltage Vth of the driving tube DTFT is implemented by the driving circuit provided in this embodiment. Non-recombined carriers in the OLED luminescent material of the light emitting element OLED are removed, thereby aging of the luminescent material is alleviated.

In this embodiment, in the second stage, the driving circuit uses the diode connection manner of the first power supply terminal ELVDD and the driving tube DTFT to obtain the threshold voltage of the driving tube DTFT at the source of the driving tube DTFT, and writes the voltage Vdata of the data signal into the capacitor Cst while obtaining the threshold voltage of the driving tube DTFT, thereby completes writing of the voltage Vdata of the data signal and compensation for the threshold voltage of the driving tube DTFT. While compensating for the threshold voltage of the driving tube DTFT (for example in the first stage and the second stage), non-recombined carriers in the internal interface of the light emitting element OLED are removed by means of short-circuiting the cathode and the anode of the light emitting element OLED, so that aging of the OLED luminescent material is alleviated and a lifespan of the luminescent material is extended.

Figure 7:
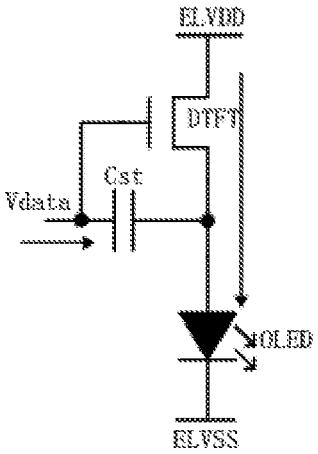
FIG. 7 is an equivalent circuit diagram of the driving circuit of FIG. 1 in the first stage in a case where the gate of the second switching tube in FIG. 1 is connected to the compensation control line.

It also needs to be noted that, when the gate of the second switching tube T2 is connected to the compensation control line C(n), in the first stage, the equivalent circuit of the driving circuit in FIG. 1 is as shown in FIG. 7. Since the compensation control line C(n) outputs a low voltage level signal, thus the second switching tube T2 is turned off, that is, the second switching tube T2 cannot short-circuit the cathode and the anode of the light emitting element OLED. And thus, in the first stage, non-recombined carriers in the interface of the light emitting layer of the light emitting element OLED cannot be removed, and thereby aging of the luminescent material cannot be alleviated.

A Second Embodiment

Figure 8:
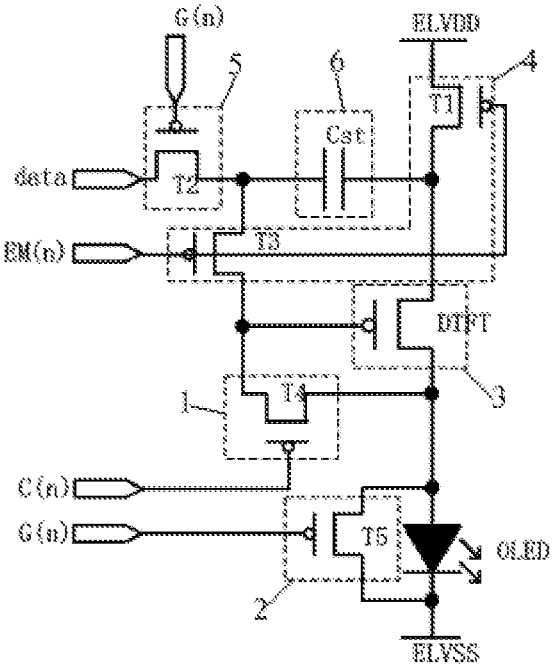
FIG. 8 is a circuit diagram of the driving circuit according to a second embodiment of the present disclosure.

This embodiment provides a driving circuit, as shown in FIG. 8, the control line includes a scan control line G(n), a compensation control line C(n), and a light emitting control line EM(n), the scan control line G(n) is connected to the data writing unit 5, the compensation control line C(n) is connected to the compensation unit 1, and the light emitting control line EM(n) is connected to the light emitting control unit 4. The power supply unit includes a first power supply terminal ELVDD connected to the compensation unit 1 and the driving unit 3, and a second power supply terminal ELVSS connected to the aging alleviation unit 2 and the light emitting element OLED.

In this embodiment, the driving unit 3 includes a driving tube DTFT; the compensation unit 1 includes a fourth switching tube T4; the light emitting control unit 4 includes a first switching tube T1 and a third switching tube T3; the data writing unit 5 includes a second switching tube T2; and the storage unit 6 includes a capacitor Cst. A gate of the first switching tube T1 is connected to the light emitting control line EM(n), a first electrode of the first switching tube T1 is connected to the first power supply terminal ELVDD, and a second electrode of the first switching tube T1 is connected to a second electrode of the capacitor Cst and a first electrode of the driving tube DTFT. A gate of the second switching tube T2 is connected to the scan control line G(n), a first electrode of the second switching tube T2 is connected to the signal line data, and a second electrode of the second switching tube T2 is connected to a first electrode of the capacitor Cst. A gate of the third switching tube T3 is connected to the light emitting control line EM(n), a first electrode of the third switching tube T3 is connected to the first electrode of the capacitor Cst and the second electrode of the second switching tube T2, and the second electrode of the third switching tube T3 is connected to the gate of the driving tube DTFT. A gate of the fourth switching tube T4 is connected to the compensation control line C(n), a first electrode of the fourth switching tube T4 is connected to the gate of the driving tube DTFT and the second electrode of the third switching tube T3, and a second electrode of the fourth switching tube T4 is connected to the second electrode of the driving tube DTFT and the anode of the light emitting element OLED. The cathode of the light emitting element OLED is connected to the second power supply terminal ELVSS.

In this embodiment, the aging alleviation unit 2 includes a fifth switching tube T5, a gate of the fifth switching tube T5 is connected to the scan control line G(n), a first electrode of the fifth switching tube T5 is connected to the anode of the light emitting element OLED, and a second electrode of the fifth switching tube T5 is connected to the cathode of the light emitting element OLED.

It should be noted that, the gate of the fifth switching tube T5 may also be connected to the compensation control line C(n). No matter the gate of the fifth switching tube T5 is connected to the scan control line G(n) or the compensation control line C(n), the fifth switching tube T5 can short-circuit the cathode and the anode of the light emitting element according to the control signal provided by the control line, thereby achieve the function of alleviating aging of the luminescent material in the light emitting element OLED.

In this embodiment, the first switching tube T1, the second switching tube T2, the third switching tube T3, the fourth switching tube T4, the fifth switching tube T5, and the driving tube DTFT are all P-type thin film transistors.

In this embodiment, the voltage Vdata of the data signal provided by the signal line data is smaller than a second supply voltage provided by the second power supply terminal ELVSS, and the first power supply voltage VDD provided by the first power supply terminal ELVDD is larger than the second power supply voltage VSS provided by the second power supply terminal ELVSS.

Other structures of the driving circuit in this embodiment are the same as those of the driving circuit in the First Embodiment, and details are not repeated here.

Figure 9:
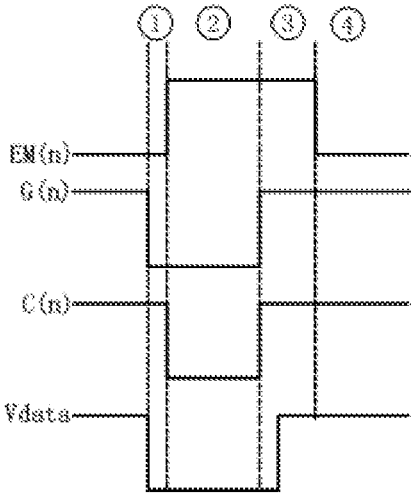
FIG. 9 is a driving timing diagram of the driving circuit of FIG. 8.

Based on the structure of the driving circuit described above, this embodiment further provides a method for driving the driving circuit, as shown in FIG. 9, the method comprises four driving stages, wherein the first electrode of the driving tube DTFT is a source, and the second electrode of the driving tube DTFT is a drain.

Figure 10:
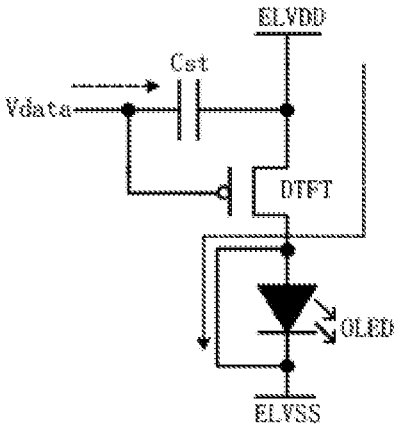
FIG. 10 is an equivalent circuit diagram of the driving circuit of FIG. 8 in a first stage.

In a first stage ①, the scan control line G(n) and the compensation control line C(n) output a low voltage level signal, and the light emitting control line EM(n) outputs a high voltage level signal. The first switching tube T1, the second switching tube T2, the third switching tube T3, and the fifth switching tube T5 are all turned on, and the fourth switching tube T4 is turned off. The equivalent circuit of the driving circuit in FIG. 8 is as shown in FIG. 10. Since the third switching tube T3 is turned on, a voltage between the gate and the source of the driving tube DTFT is a voltage difference between two terminals of the capacitor Cst. Turning-on of the second switching tube T2 enables the data signal provided by the signal line data (i.e., the voltage Vdata of the data signal) to be directly written into the first electrode of the capacitor Cst that is connected to the gate of the driving tube DTFT; turning-on of the first switching tube T1 and the fifth switching tube T5 pulls the drain of the driving tube DTFT to a potential of the second power supply terminal ELVSS (i.e., the second power supply voltage ELVSS), meanwhile, the cathode and the anode of the light emitting element OLDE is short-circuited by the fifth switching tube T5, thus, in the first stage, non-recombined carriers in the internal interface of the light emitting layer of the light emitting element OLED can be removed, and aging of the luminescent material of the light emitting element OLED can be alleviated. Meanwhile, the capacitor Cst is charged, the voltage difference between two terminals of the capacitor Cst after the completion of charging is VCst=VDD−Vdata. Because the driving tube DTFT has a relatively large gate-source voltage in this stage, thus the current flowing through the driving tube DTFT is relatively large, the capacitor Cst is charged at a relatively fast speed, thereby a time period of the first stage may be relatively short.

Figure 11:
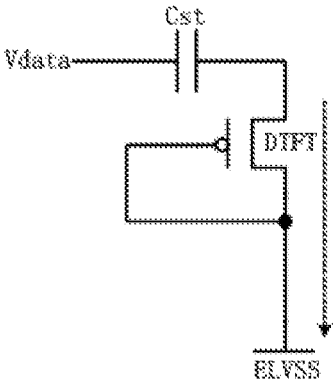
FIG. 11 is an equivalent circuit diagram of the driving circuit of FIG. 8 in a second stage.

In a second stage ②, the scan control line G(n) and the compensation control line C(n) output a low voltage level signal, and the light emitting control line EM(n) outputs a high voltage level signal. The first switching tube T1 and third switching tube T3 are turned off, and the second switching tube T2, the fourth switching tube T4, and the fifth switching tube T5 are turned on. In this stage, the equivalent circuit of the driving circuit in FIG. 8 is as shown in FIG. 11. Since the third switching tube T3 is turned off and the fourth switching tube T4 is turned on, thus the driving tube DTFT is connected in a manner of diode, potentials of the gate and the drain of the driving tube DTFT are both the second power supply voltage VSS; and since the source of the driving tube DTFT maintains the first power supply voltage VDD in the previous stage, the first electrode of the capacitor Cst is connected to the signal line data, the second electrode of the capacitor Cst is connected to the source of the driving tube DTFT, in this case, the source of the driving tube DTFT is already disconnected from the first power supply terminal ELVDD, thus the capacitor Cst discharges through the driving tube DTFT, until the potential of the source of the driving tube DTFT drops to VSS+|Vth| (where Vth is the threshold voltage of the driving tube DTFT, and VSS is the second power supply voltage), in this case, the driving tube DTFT is turned off, the voltage difference between two terminals of the capacitor Cst is VCst=VSS+|Vth|−Vdata. In addition, in this stage, the cathode and the anode of the light emitting element OLED is short-circuited, non-recombined carriers in the internal interface of the light emitting layer of the light emitting element OLED are removed, and aging of the luminescent material is further alleviated.

Figure 12:
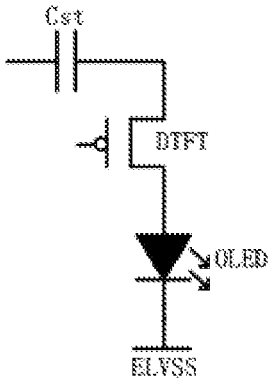
FIG. 12 is an equivalent circuit diagram of the driving circuit of FIG. 8 in a third stage.

In a third stage ③, the control signals of the scan control line G(n), the compensation control line C(n), and the light emitting control line EM(n) all output a high voltage level signal. The first switching tube T1 the second switching tube T2, the third switching tube T3, the fourth switching tube T4, and the fifth switching tube T5 all are turned off. The equivalent circuit of the driving circuit in FIG. 8 is as shown in FIG. 12. This stage serves as a buffering stage, which avoids interference caused by that the control signals of the scan control line G(n), the compensation control line C(n), and the light emitting control line EM(n) jump simultaneously, so that signals in the whole driving circuit are more stable.

Figure 13:
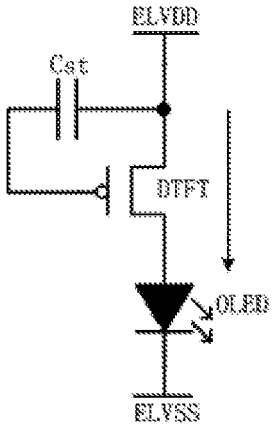
FIG. 13 is an equivalent circuit diagram of the driving circuit of FIG. 8 in a fourth stage.

In a fourth stage ④, the scan control line G(n) and the compensation control line C(n) output a high voltage level signal, and the light emitting control line EM(n) outputs a low voltage level signal. Thus the first switching tube T1 and the third switching tube T3 are turned on, and the second switching tube T2, the fourth switching tube T4, and the fifth switching tube T5 are all turned off. The equivalent circuit of the driving circuit in FIG. 8 is as shown in FIG. 13. The third switching tube T3 is turned on, the capacitor Cst is connected between the gate and the source of the driving tube DTFT, the anode of the light emitting diode OLED is connected to the drain of the driving tube DTFT, and the cathode of the light emitting diode OLED is connected to the second power supply terminal ELVSS. Since the gate of the driving tube DTFT connected to the capacitor Cst is in a floating state, the voltage between two terminals of the capacitor Cst maintains the previous voltage, that is, VCst=VSS+|Vth|−Vdata. And the capacitor Cst is connected between the gate and the source of the driving tube DTFT, thus the voltage between the source and the gate of the driving tube DTFT is the voltage difference VCst between two terminals of the capacitor Cst. The second power supply voltage VSS is set to ensure that the voltage Vds between the drain and the source of the driving tube DTFT satisfies |Vds|>Vsg−Vth, so as to make the driving tube DTFT operate in a saturated state. Accordingly, a light emitting current of the light emitting element OLED is:

$$\begin{aligned} Ioled &= K(Vgs - |Vth|)^2 \\ &= K(VCst - |Vth|)^2 \\ &= K(VSS + |Vth| - Vdata - |Vth|)^2 \\ &= K(VSS - Vdata)^2 \end{aligned}$$

It should be noted that, in this embodiment, the voltage Vdata of the data signal is smaller than the second power supply terminal VSS. K is a constant associated with manufacturing process and design.

It can be known from the above equations that, the light emitting current provided by the driving circuit in this embodiment to drive the light emitting element OLED is only related to the voltage Vdata of the data signal and the second power supply voltage VSS, but is irrelevant to the threshold voltage Vth of the driving tube DTFT, in other words, compensation for the threshold voltage Vth of the driving tube DTFT is implemented by the driving circuit provided in this embodiment Non-recombined carriers in the luminescent material of the light emitting element OLED are removed, thereby aging of the luminescent material is alleviated.

In this embodiment, in the second stage, the driving circuit uses the diode connection manner of the second power supply terminal ELVSS and the driving tube DTFT to obtain the threshold voltage of the driving tube DTFT at the source of the driving tube DTFT, and writes the voltage Vdata of the data signal into the capacitor Cst while obtaining the threshold voltage of the driving tube DTFT, thereby completes writing of the voltage Vdata of the data signal and compensation for the threshold voltage of the driving tube DTFT. While compensating for the threshold voltage of the driving tube DTFT (for example in the first stage and the second stage), non-recombined carriers in the internal interface of the light emitting element OLED are removed by means of short-circuiting the cathode and the anode of the light emitting element OLED, and thereby aging of the luminescent material of the light emitting element OLED is alleviated and a lifespan of the luminescent material is extended.

Figure 14:
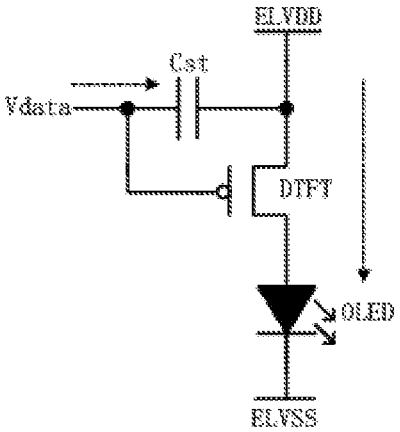
FIG. 14 is an equivalent circuit diagram of the driving circuit of FIG. 8 in the first stage in a case where the gate of the fifth switching tube in FIG. 8 is connected to the compensation control line.

It also needs to be noted that, when the gate of the fifth switching tube T5 is connected to the compensation control line C(n), the equivalent circuit of the driving circuit in FIG. 8 is as shown in FIG. 14. Since the compensation control line C(n) outputs a high voltage level signal, thus the fifth switching tube is turned off, and the fifth switching tube T5 cannot short-circuit the cathode and the anode of the light emitting element OLED, in this case, non-recombined carriers in the interface of the light emitting layer of the light emitting element OLED cannot be removed, thereby aging of the luminescent material of the light emitting element OLED cannot be alleviated.

Advantageous effects of First Embodiment and Second Embodiment: by means of setting the compensation unit, the aging alleviation unit, the driving unit, the light emitting control unit, the data writing unit, and the storage unit, the driving circuit provided by the First Embodiment and the Second Embodiment can achieve compensation for the threshold voltage of the driving unit, make the driving currents of respective driving units tend to be consistent, and thereby ensure uniformity of luminance of the light emitting element; moreover, non-recombined carriers in the internal interface of the light emitting layer of the light emitting element can also be removed by means of short-circuiting the cathode and the anode of the light emitting element, and aging of the luminescent material and extend a lifespan of the luminescent material is thereby alleviated.

A Third Embodiment

This embodiment provides a display device, comprising a light emitting element, and further comprising the driving circuit described in either of the First Embodiment and the Second Embodiment, the driving circuit being connected to the light emitting element and configured to drive the light emitting element.

The light emitting element may be an organic electroluminescent light emitting diode.

By adopting the driving circuit described in either of the First Embodiment and the Second Embodiment, the driving currents for the respective pixels in the display device are made consistent during the process of driving, which thereby ensures luminance uniformity during displaying of the display device; meanwhile the lifespan of the display device can be extended.

As will be appreciated, the above embodiments are merely exemplary implementations adopted to illustrate the principles of the present disclosure; however, the present disclosure is not limited thereto. Obviously, those of ordinary skill in the art can make various modifications and variations to the present disclosure without departing from the spirit and scope thereof, and these modifications and variations also fall into the protection scope the present disclosure.

The invention claimed is:

1. A driving circuit for driving a light emitting element, the driving circuit comprising a signal line, a control line, a driving unit, a power supply unit, a compensation unit, a light emitting control unit, a data writing unit, a storage unit, and an aging alleviation unit, wherein the control line comprises a scan control line, a compensation control line, and a light emitting control line;

the power supply unit is configured to provide a power supply signal for the driving circuit, the driving unit is configured to drive the light emitting element, wherein the driving unit comprises a driving tube, the signal line is configured to provide a data signal for the data writing unit, the control line is configured to provide control signals for the compensation unit, the light emitting control unit, the data writing unit, and the aging alleviation unit, the light emitting control unit is connected to the light emitting control line, and is configured to control the light emitting element to emit a light, the data writing unit is connected to the scan control line, and is configured to write the data signal into the storage unit, the storage unit is configured to store a voltage of the data signal written by the data writing unit and includes a capacitor, the capacitor comprises a first electrode and a second electrode, the compensation unit is connected to the compensation control line, and is configured to perform a threshold voltage compensation for the driving unit according to the control signal, and the aging alleviation unit is configured to short-circuit a cathode and an anode of the light emitting element according to the control signal, wherein the light emitting control unit comprises a first switching tube and a third switching tube, the compensation unit comprises a fourth switching tube, and wherein a gate of the first switching tube is connected to the light emitting control line, a first electrode of the first switching tube is connected to the power supply unit, and a second electrode of the first switching tube is connected to the second electrode of the capacitor and a first electrode of the driving tube, a gate of the third switching tube is connected to the light emitting control line, a first electrode of the third switching tube is connected to the first electrode of the capacitor and the data writing unit, and the second electrode of the third switching tube is connected to a gate of the driving tube, a gate of the fourth switching tube is connected to the compensation control line, a first electrode of the fourth switching tube is connected to the gate of the driving tube and the second electrode of the third switching tube, and a second electrode of the fourth switching tube is connected to a second electrode of the driving tube and the anode of the light emitting element.

2. The driving circuit according to claim 1, wherein the power supply unit comprises a first power supply terminal and a second power supply terminal, wherein the first power supply terminal is connected to the compensation unit and the driving unit, and the second power supply terminal is connected to the aging alleviation unit and the light emitting element.

3. The driving circuit according to claim 2, wherein the data writing unit comprises a second switching tube, and wherein a gate of the second switching tube is connected to the scan control line, a first electrode of the second switching tube is connected to the signal line, and a second electrode of the second switching tube is connected to a first electrode of the capacitor, and the cathode of the light emitting element is connected to the second power supply terminal.

4. The driving circuit according to claim 3, wherein the aging alleviation unit comprises a fifth switching tube, and wherein a gate of the fifth switching tube is connected to the compensation control line or the scan control line, a first electrode of the fifth switching tube is connected to the anode of the light emitting element, and a second electrode of the fifth switching tube is connected to the cathode of the light emitting element.

5. The driving circuit according to claim 4, wherein the first switching tube, the second switching tube, the third switching tube, the fourth switching tube, the fifth switching tube, and the driving tube are all P-type thin film transistors.

6. The driving circuit according to claim 5, wherein a voltage of the data signal provided by the signal line is smaller than a second supply voltage provided by the second power supply terminal.

7. The driving circuit according to claim 6, wherein the first power supply voltage provided by the first power supply terminal is larger than the second power supply voltage provided by the second power supply terminal.

8. A display device, comprising a light emitting element, and further comprising a driving circuit according to claim 1, the driving circuit being connected to the light emitting element and being configured to drive the light emitting element.

9. The display device according to claim 8, wherein, in the driving circuit, the power supply unit comprises a first power supply terminal and a second power supply terminal, wherein the first power supply terminal is connected to the compensation unit and the driving unit, and the second power supply terminal is connected to the aging alleviation unit and the light emitting element.

10. The display device according to claim 9, wherein the compensation unit comprises a fourth switching tube, the data writing unit comprises a second switching tube, and wherein a gate of the second switching tube is connected to the scan control line, a first electrode of the second switching tube is connected to the signal line, and a second electrode of the second switching tube is connected to a first electrode of the capacitor, a gate of the fourth switching tube is connected to the compensation control line, a first electrode of the fourth switching tube is connected to the gate of the driving tube and the second electrode of the third switching tube, and a second electrode of the fourth switching tube is connected to the second electrode of the driving tube and the anode of the light emitting element, and the cathode of the light emitting element is connected to the second power supply terminal.

11. A method for driving a driving circuit according to claim 1, the method comprising:

providing, by the power supply unit, the power supply signal for the driving circuit, driving, by the driving unit, the light emitting element to emit light under control of a control line, providing, by the signal line, a data signal for a data writing unit under control of the control line, controlling, by the light emitting control unit, the light emitting element to emit light under control of the control line, writing, by the data writing unit, the data signal into the storage unit under control of the control line, storing, by the storage unit, the voltage of the data signal written by the data writing unit, performing, by the compensation unit, threshold voltage compensation for the driving unit under control of the control line, and short-circuiting, by the aging alleviation unit, the cathode and the anode of the light emitting element under control of the control line.

12. The method according to claim 11, wherein the control line comprises a scan control line, a compensation control line, and a light emitting control line, and wherein the power supply unit comprises a first power supply terminal and a second power supply terminal, and wherein the method comprises four stages, wherein in a first stage, the signal line writes the data signal into the storage unit through the data writing unit under control of the scan control line, and meanwhile the aging alleviation unit short-circuits the cathode and the anode of the light emitting element under control of the scan control line, in a second stage, the compensation unit performs threshold voltage compensation under control of the compensation control line, and meanwhile the aging alleviation unit continues to short-circuit the cathode and the anode of the light emitting element under control of the scan control line, in a third stage, the control signals of the scan control line and the compensation control line jump simultaneously, and the compensation unit, the light emitting control unit, the data writing unit, and the aging alleviation unit are simultaneously turned off, and in a fourth stage, the light emitting control unit controls the light emitting element to emit light under control of the light emitting control line.

13. The method according to claim 12, wherein in the first stage, the light emitting control line and the scan control line output a first voltage level, and the compensation control line outputs a second voltage level, in the second stage, the light emitting control line outputs the second voltage level, and the scan control line and the compensation control line output the first voltage level, in the third stage, the light emitting control line, the scan control line, and the compensation control line output the second voltage level, and in the fourth stage, the light emitting control line outputs the first voltage level, and the scan control line and the compensation control line output the second voltage level, and wherein the first voltage level and the second voltage level are one of a high voltage level and a low voltage level, respectively.

14. The method according to claim 12, wherein the first power supply terminal is connected to the compensation unit and the driving unit, and the second power supply terminal is connected to the aging alleviation unit and the light emitting element.

* * * * *